United States Patent [19]

Dautreppe et al.

[11] 3,933,266

[45] Jan. 20, 1976

[54] BOTTLE CAP SEAL

[75] Inventors: Bernard Dautreppe, Reims; Michel Lallemang, Justices, both of France

[73] Assignee: Chisalu, Mareuil-sur-ay, France

[22] Filed: Nov. 24, 1972

[21] Appl. No.: 308,993

[52] U.S. Cl. ..... 215/316; 215/10

[51] Int. Cl.[2] ..... B65D 41/00

[58] Field of Search ..... 215/10, 38 B, 316

[56] References Cited

UNITED STATES PATENTS

| | | | |
|---|---|---|---|
| 2,666,542 | 1/1954 | Price | 215/38 B |
| 3,415,034 | 12/1968 | Schmitt | 215/38 B X |

*Primary Examiner*—William Price
*Assistant Examiner*—Ro E. Hart
*Attorney, Agent, or Firm*—McDougall, Hersh & Scott

[57] ABSTRACT

A bottle cap seal having a long skirt in which the seal is of the type which is used on sparkling wine and champagne bottles.

The cap, formed by rolling a thin metal sheet on a punch and by gluing the superposed lateral edges, is formed with a depression in the gluing zone, adjacent its upper edge. The depression operates to prevent excessive penetration of one cap into the other during handling, with the result that the caps are easily adapted for use with automatic distribution and sealing machines.

1 Claim, 4 Drawing Figures

BOTTLE CAP SEAL

This invention relates to an improvement in long skirt bottle cap seals.

Long skirt caps are used mainly for sealing sparkling wine and champagne bottles. They are formed by rolling a thin pre-cut sheet cut to form, such as of aluminum, or a punch of frustoconical shape, with both edges of the sheet aligned and joined by gluing over the entire length of the skirt.

Due to their frustoconical shape, the caps can be stacked one on another. The stacked caps form a "stick" which to a certain extent is capable of resisting deformations which might otherwise occur. However, in transportation, a certain amount of packing occurs and this packing poses a problem when the caps are transferred to the necks of the bottles. For example, when a cap is removed from the stack in which an excessive amount of telescoping has taken place, it may remain wedged and the bottle is then often provided with two superposed caps. Since the one on the outside does not adhere to the glass of the bottle it more or less eventually becomes detached and presents an aspect which is not desirable.

The problem becomes particularly serious when the caps are being dispensed automatically, since their mechanical separation is even more difficult than manual separation, causing frequent shut-down of the sealing machine.

Attempts have been made to remedy this problem by providing the cap with an annular groove at about the height of the skirt. This groove functions as a stop to prevent a cap from advancing too deeply into the one in which it is stacked.

However, this solution is faced with several disadvantages. On the one hand, the annular groove cannot be applied at the time that the cap is formed but must be carried out at a separate station. On the other hand, the annular groove debilitates the axial resistance of the head of the cap. At the time of sealing, the cap remains hooked to the edge of the stopper or the bottle neck, forming a hollow which is sooner or later crushed. Oftentimes the groove is crushed even before unstacking.

It is an object of this invention to remedy these deficiencies and resolve the problems that arise. In accordance with the practice of this invention, use is made of a long skirt cap of thin sheet having a depression at the height of the skirt, that is, near the closed side of the cap. It is important for this depression to be placed precisely in the area where both edges of the format, at which the cap is formed, are superposed; the operation is further facilitated by the fact that this area necessarily is free of any vertical grooves, which normally stiffen this part of the skirt.

The depression preferably is produced at the time of the shaping of the cap, before the glue uniting both edges has had time to solidify.

The invention also relates to the tool necessary to bring about the described deformation in the cap. It comprises on the one hand, a punch, known per se, which, at the point provided for the formation of the depression, has a notch of a configuration analogous to that of the depression, and, on the other hand, on the heating press, known per se, a tip whose terminal conformation corresponds with the notch of the punch.

These and other objects and advantages of this invention will hereinafter appear and for purposes of illustration, but not of limitation, an embodiment of the invention is shown in the accompanying drawings in which.

Figure 1:
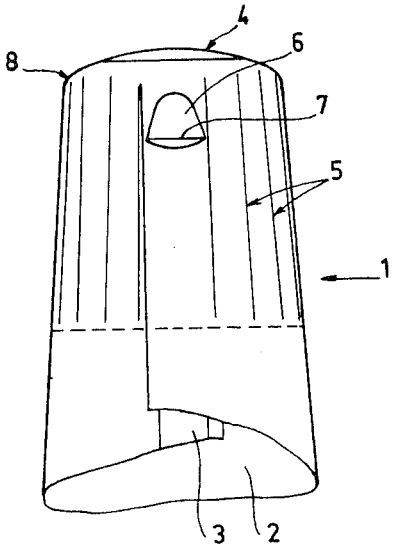
FIG. 1 is a front elevational view of a cap showing the embodiment according to the invention.

The long skirt capsule 1, only the upper part of which is shown in FIG. 1, is formed from a thin sheet 2 of metal, such as aluminum, with the lateral edges aligned along a zone 3. it is closed in a known manner, as by folding the free upper edge of the sheet 2; the irregular folds which form at the top can be hidden by a small piece 4, such as a tax stamp.

A certain number of vertical grooves or corrugations 5 are formed in the upper part of the skirt to give this segment axial rigidity, combined with a certain radial elasticity. This configuration facilitates the threading of the cap on the stopper head, which normally extends upwardly and laterally beyond the bottle neck.

In the lining area 3 of the sheet, a depression 6, which constitutes the essential point of this invention, is provided. This depression 6, the bottom line 7 of which is about 10 mm from the upper edge 8 of the skirt, extends into the skirt to such a depth that it is located on the inside of the orthogonal projection of the sealed bottom which it thus resists to act as a stop as the stacked cap is advanced.

Figure 2:
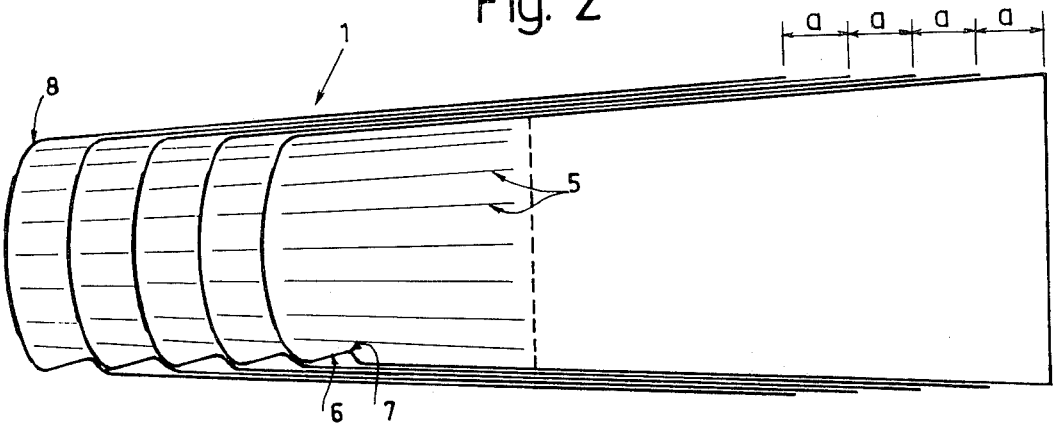
FIG. 2 is a sectional view of several stacked caps.
Figure 3:
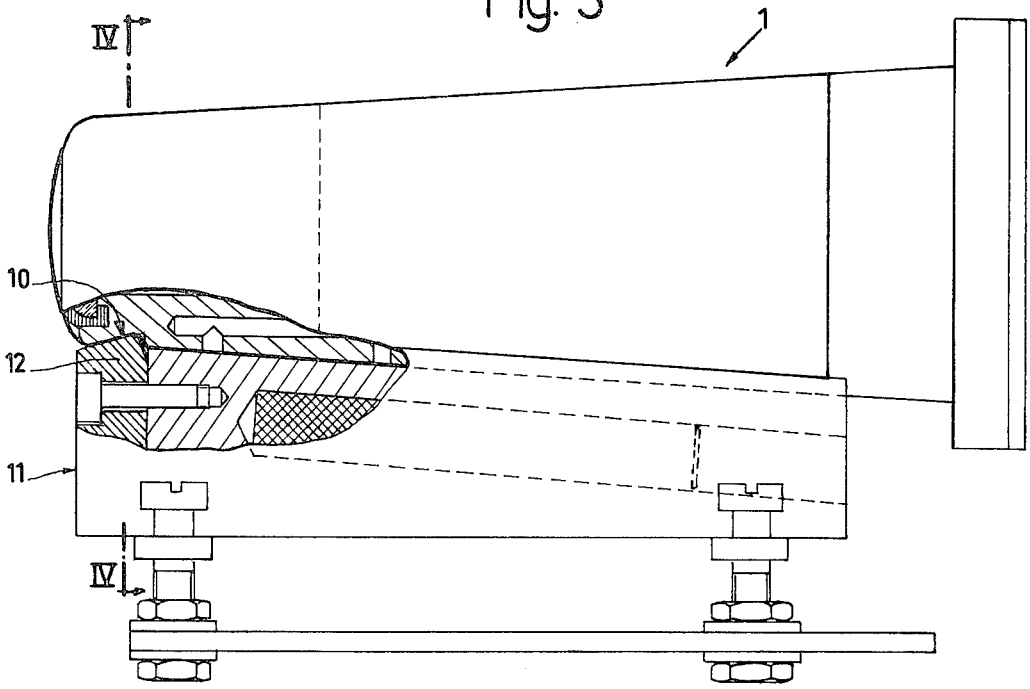
FIG. 3 is an elevational view partially in section of a tool used for the formation of a cap.
Figure 4:
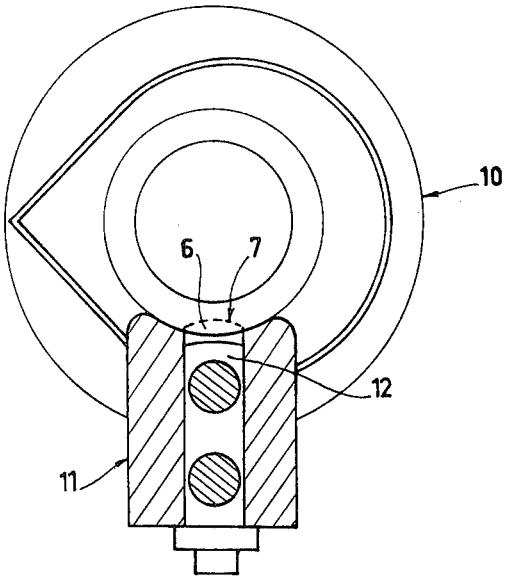
FIG. 4 is a sectional view taken along the line IV—IV of FIG. 3.

As a result, the caps stack (FIG. 2) at a very regular stacking pace *a* and this spaced relation is maintained, despite all handlings and vibrations in transit.

The selection of the location of the depression 6 is important. Indeed, zone 3 which is free of grooves offers greater rigidity than the remainder of the skirt, due to the fact that, at this location, the cap offers a double sheet thickness. This resistance to deformation is further increased if, as in the present invention, the depression is formed at the time when the glue combining both superposed edges of the format 2 has not yet hardened.

Because, preferably, use is made of a heat sensitive adhesive, it is recommended to form the depression 6 on the same punch 9 which is used to form the cap 3.

The frustoconical punch 9, which is of a generally known shape, has only one particularity, namely, a notch 10 provided in the proximity of its free end, at the location provided for forming the depression 6.

At the end of the shaping operation, both aligned edges of the format are pressed on each other and heated by the heating press 11. Press 11 is provided with a rounded tip 12 having a configuration corresponding with that of the notch 10 against which it urges the skirt portion to effect the desired depression as the two sections are brought together for joinder.

Because this operation is carried out at the time when the adhesive melting under heat has not yet hardened, the depression is maintained and disappears only at the time when the cap is threaded on the stopper of the bottle.

It will be understood that changes may be made in the details of construction and operation without departing from the spirit of the invention, especially as defined in the following claims.

We claim:

1. A bottle cap formed of a soft metal sheet having a closed upper end and a long skirt portion of frustoconical shape and having corrugations therein with the lateral edge portions overlapped for joinder, an adhesive which is hardened in between the overlapped lateral edge portions to interbond the overlapped edge portions of the sheet and in which the overlapped edge portions are free of corrugations, and a single depression through the overlapped edge portions, in which the depression is formed while the adhesive is still in the unhardened state and in which the depression is located in the upper edge portion where the frustoconical skirt portion meets the top.

* * * * *